US008427312B2

(12) United States Patent
Marmigere et al.

(10) Patent No.: US 8,427,312 B2
(45) Date of Patent: Apr. 23, 2013

(54) TAMPER DETECTION, MEMORIZATION, AND INDICATION FOR PACKAGING

(75) Inventors: Gerard Marmigere, Drap (FR); Bernard Pucci, Cagnes-sur-Mer (FR); Xavier Rey-Robert, La Gaude (FR); Pierre Secondo, Tourrettes-sur-Loup (FR)

(73) Assignee: International Business Machines Corporation, Armonk, NY (US)

( * ) Notice: Subject to any disclaimer, the term of this patent is extended or adjusted under 35 U.S.C. 154(b) by 1136 days.

(21) Appl. No.: 12/353,424

(22) Filed: Jan. 14, 2009

(65) Prior Publication Data

US 2010/0123580 A1 May 20, 2010

(30) Foreign Application Priority Data

Nov. 19, 2008 (EP) ..... 08305814

(51) Int. Cl.
*G08B 13/00* (2006.01)

(52) U.S. Cl.
USPC ..... 340/541; 340/542; 340/546; 340/550; 340/555; 340/556; 340/568.1; 340/568.7; 340/572.1; 340/572.4; 340/572.7

(58) Field of Classification Search ..... 340/541, 340/542, 546, 550, 555, 556, 568.1, 568.7, 340/572.1, 572.4, 572.7
See application file for complete search history.

(56) References Cited

U.S. PATENT DOCUMENTS

| | | | | |
|---|---|---|---|---|
| 4,242,670 | A * | 12/1980 | Smith | 340/555 |
| 4,255,745 | A * | 3/1981 | Rohan et al. | 340/546 |
| 7,183,918 | B1 | 2/2007 | Nichols, Sr. | |
| 7,342,497 | B2 | 3/2008 | Chung et al. | |
| 7,982,604 | B2 * | 7/2011 | Nichols et al. | 340/541 |
| 2004/0041706 | A1 | 3/2004 | Stratmoen et al. | |
| 2005/0034420 | A1 | 2/2005 | Radlinger et al. | |

* cited by examiner

*Primary Examiner* — Tai T Nguyen
(74) *Attorney, Agent, or Firm* — Douglas A. Lashmit; Hoffman Warnick LLC

(57) ABSTRACT

The present invention is directed to tamper detection, memorization, and indication for packaging. A method in accordance with an embodiment of the present invention includes: detecting when the package is opened and closed; and generating an alarm if the package is opened more than once after it is initially closed to indicate that the package has been tampered with.

5 Claims, 7 Drawing Sheets

TAMPER DETECTION, MEMORIZATION, AND INDICATION FOR PACKAGING

FIELD OF THE INVENTION

The present invention relates to packaging. More specifically, the present invention is directed to tamper detection, memorization, and indication for packaging.

BACKGROUND OF THE INVENTION

With the growing number of goods bought via the Internet, postal services are facing an increasing number of incidents reported by customers. Such incidents may include, for example, stolen packages, contents of packages stolen, replaced, or tampered with, etc. A malicious person can open a package and steal, replace, or damage the contents of the package. Then, the package can be closed again without any external visible sign indicating that the package has been tampered with.

SUMMARY OF THE INVENTION

The present invention is directed to tamper detection, memorization, and indication for packaging. The present invention allows the recipient of a package to easily determine if the package was opened between the time the package was initially closed and the time the package is received by the recipient. An opening detection mechanism is provided that is capable of memorizing whether the package has been opened, even if the package has been closed again afterwards. Upon opening the package, the legitimate recipient of the package is informed (e.g., via a visual indicator) if the package was previously opened.

A first aspect of the present invention is directed to a method for tamper detection of a package, comprising: detecting when the package is opened and closed; and generating an alarm if the package is opened more than once after it is initially closed to indicate that the package has been tampered with.

A second aspect of the present invention is directed to a system for tamper detection of a package, comprising: a light detecting system for detecting when the package is opened; and a system for generating an alarm if the package is opened more than once after it is initially closed to indicate that the package has been tampered with.

A third aspect of the present invention is directed to a package, comprising: a light detecting system for detecting when the package is opened; and a system for generating an alarm if the package is opened more than once after it is initially closed to indicate that the package has been tampered with; wherein the light detecting system and the system for generating an alarm are embedded into a material forming the package.

The illustrative aspects of the present invention are designed to solve the problems herein described and other problems not discussed.

BRIEF DESCRIPTION OF THE DRAWINGS

These and other features of this invention will be more readily understood from the following detailed description of the various aspects of the invention taken in conjunction with the accompanying drawings.

Figure 1:
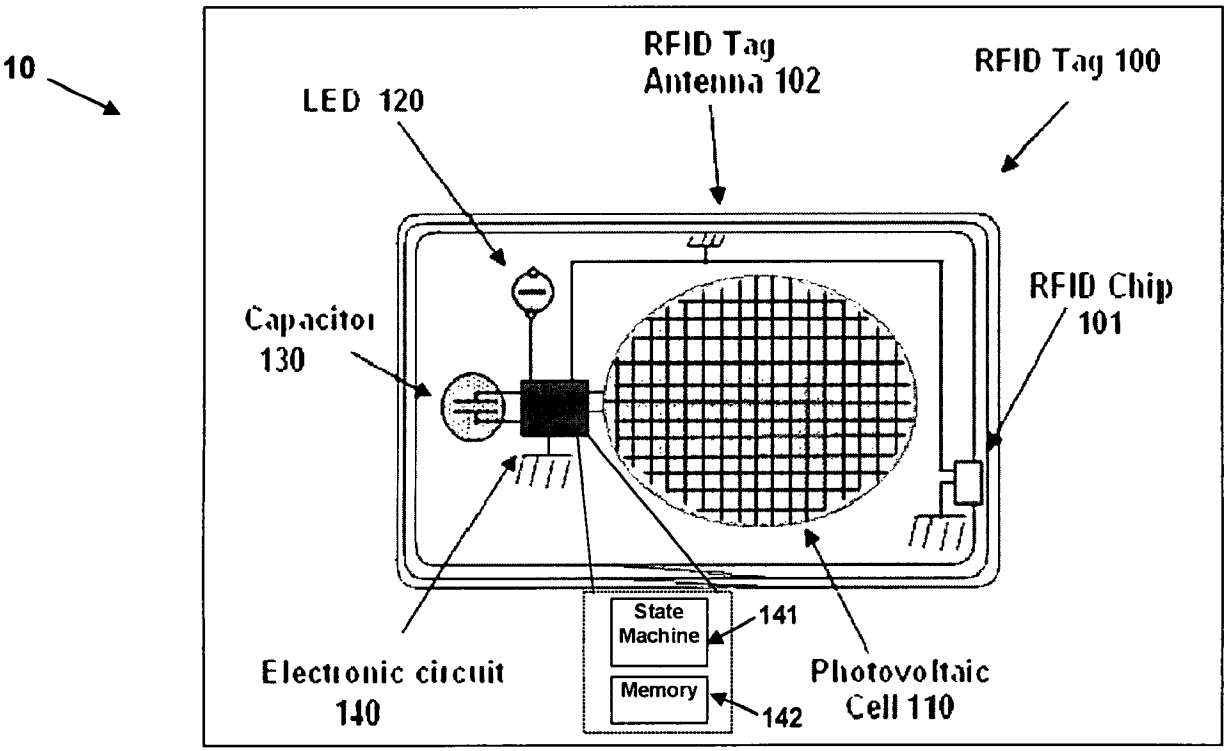
FIG. 1 depicts a tamper detection, memorization, and indication system for packaging in accordance with an embodiment of the present invention.

The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

As detailed above, the present invention is directed to tamper detection, memorization, and indication for packaging.

FIG. 1 depicts a tamper detection, memorization, and indication (TDMI) system 10 for a package in accordance with an embodiment of the present invention. The TDMI system 10 comprises a radio frequency identification (RFID) tag 100 coupled to a photovoltaic cell 110 via an electronic circuit 140.

The photovoltaic cell 110 powers the electronic circuit 140 and provides the electronic circuit 140 with light/no-light information, which is stored by the electronic circuit 140. The electronic circuit 140 directs the energy produced by the photovoltaic cell 110 to an RFID chip 101 and capacitor 130. The energy produced by the photovoltaic cell 110 loads the capacitor 130, which is used to supplement the energy produced by the photovoltaic cell 110 for a short time after the photovoltaic cell 110 is shut off. Other light detecting systems capable of detecting the presence/absence of light can also be used in the practice of the present invention.

The electronic circuit 140 includes a finite state machine 141 and a permanent memory 142. The electronic circuit 140 stores the status of the finite state machine 141 in the permanent memory 142. In accordance with the present invention, the status of the finite state machine 141 may have the values:

INACTIVE;
ACTIVE;
MONITOR;
1st OPEN DETECTED; and
TAMPER DETECTED.

Other values are also possible depending, for example, on the specific implementation/application of the present invention.

Figure 2:
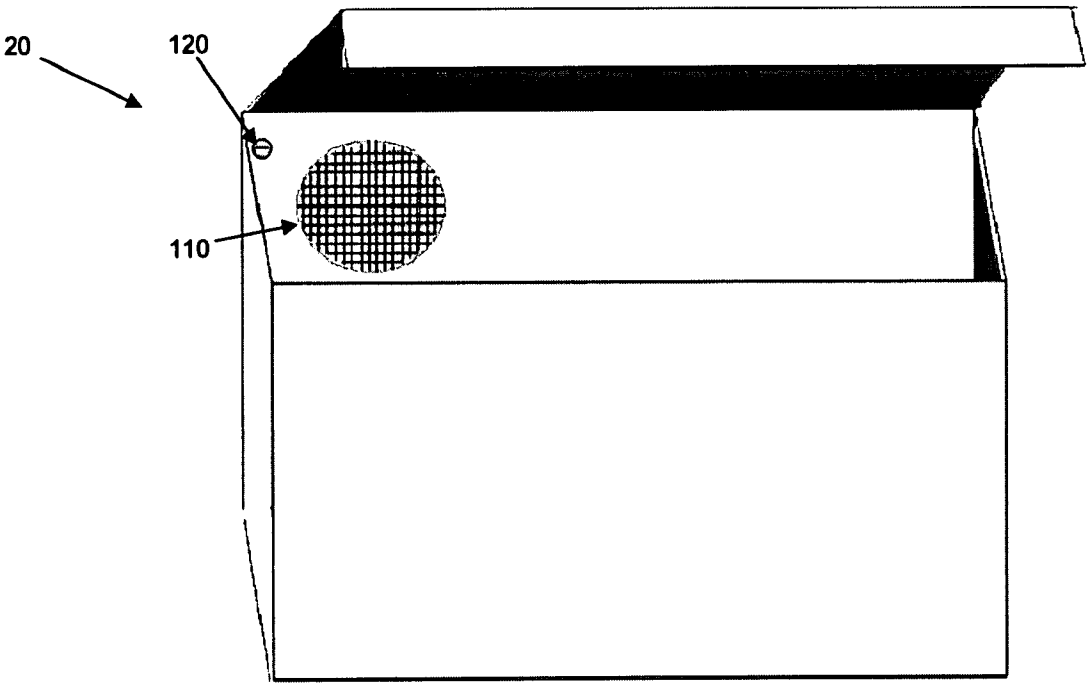
FIG. 2 depicts an illustrative package in accordance with an embodiment of the present invention.

As depicted in FIG. 2, the TDMI system 10 is embedded into the material (e.g., cardboard, plastic, etc.) used to form a package 20. Inside the package 20, only the photovoltaic cell 110 and the LED 120 remain visible. In FIG. 2, the TDMI system 10 is depicted as being embedded into the rear wall of the package 20. However, the TDMI system 10 can be embedded into any suitable portion of the package 20 (e.g., side wall, top, bottom, etc.) without departing from the intended scope of the present invention.

The operation of the TDMI system 10 will now be described.

Figure 3:
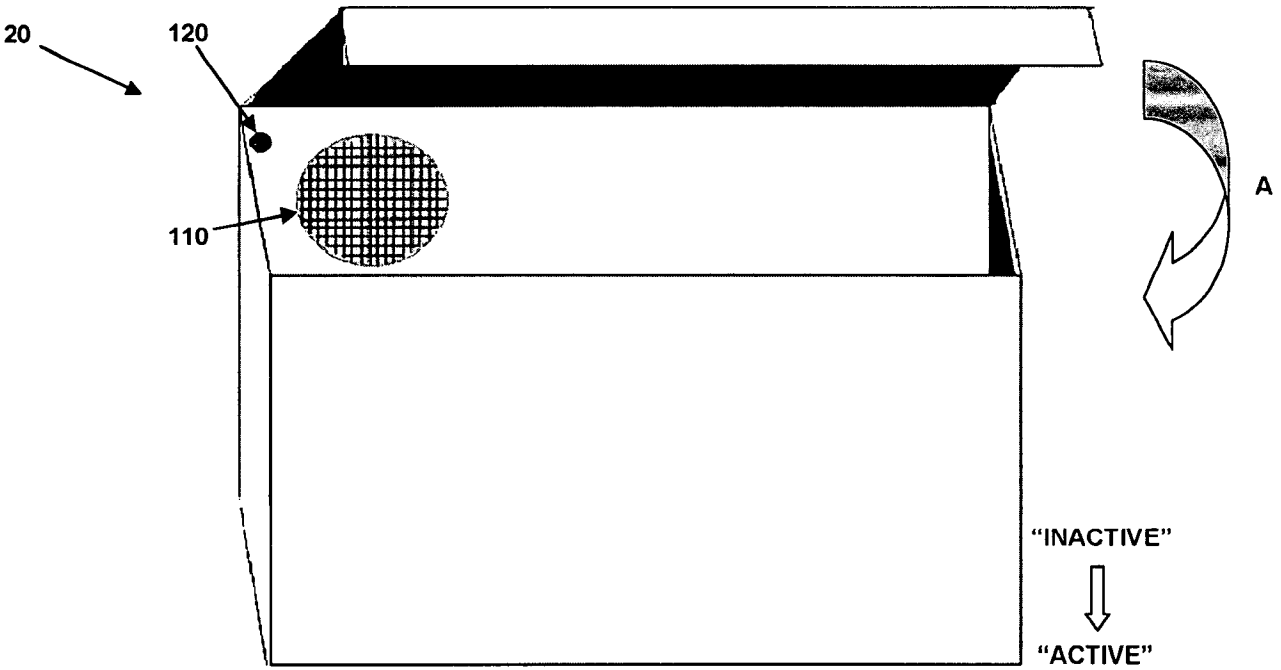
FIGS. 3-6 depict the operation of the detection, memorization, and indication system for packaging in accordance with an illustrative embodiment of the present invention.

Initially, before the package 20 is closed, the TDMI system 10 is in an "inactive" state. As depicted in FIG. 3, the photovoltaic cell 110 detects incident light when the package 20 is opened and loads the capacitor 130, which powers the electronic circuit 140.

After the package 20 is closed (arrow A), the electronic circuit 140 detects that the photovoltaic cell 110 is no longer exposed to light, and sets the state of the TDMI system 10 to "active." The electronic circuit 140 latches this state information in its permanent memory 141.

Figure 4:
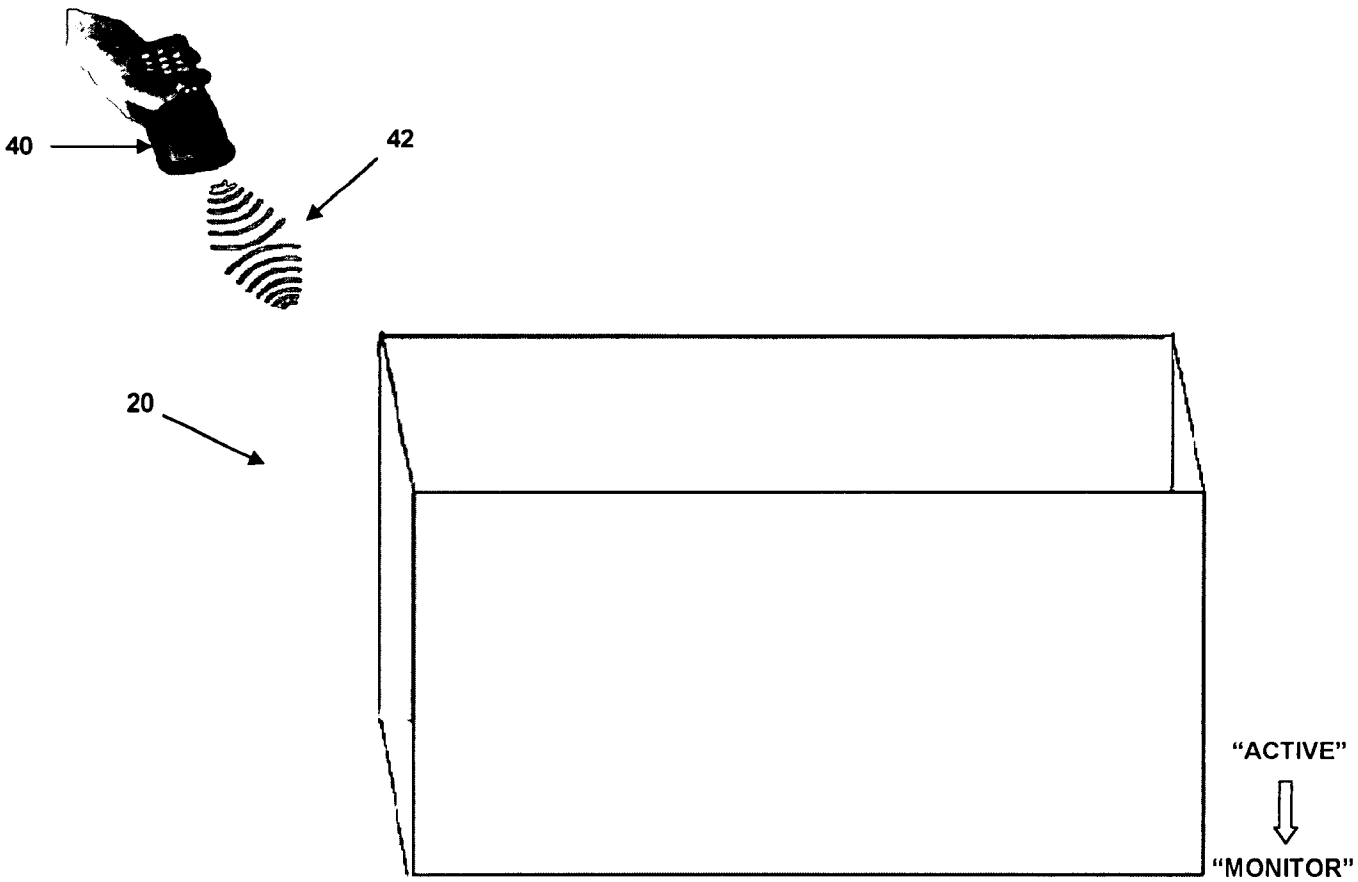

A user (e.g., a sender of the package 20) subsequently sets the state of the TDMI system 10 to "monitor" and sends the package 20 out for delivery. As depicted in FIG. 4, an RFID tag reader/encoder 40 can be used to send a "monitor" command 42 to the RFID chip 101 of the TDMI system 10 via an RFID tag antenna 102 to set the state of the TDMI system 10 to "monitor." In response, the RFID chip 101 transmits the "monitor" state information to the electronic circuit 140, which latches this state information in its permanent memory 141. To perform this operation, the electronic circuit 140 is powered by the energy that previously accumulated in the capacitor 130.

Figure 5:
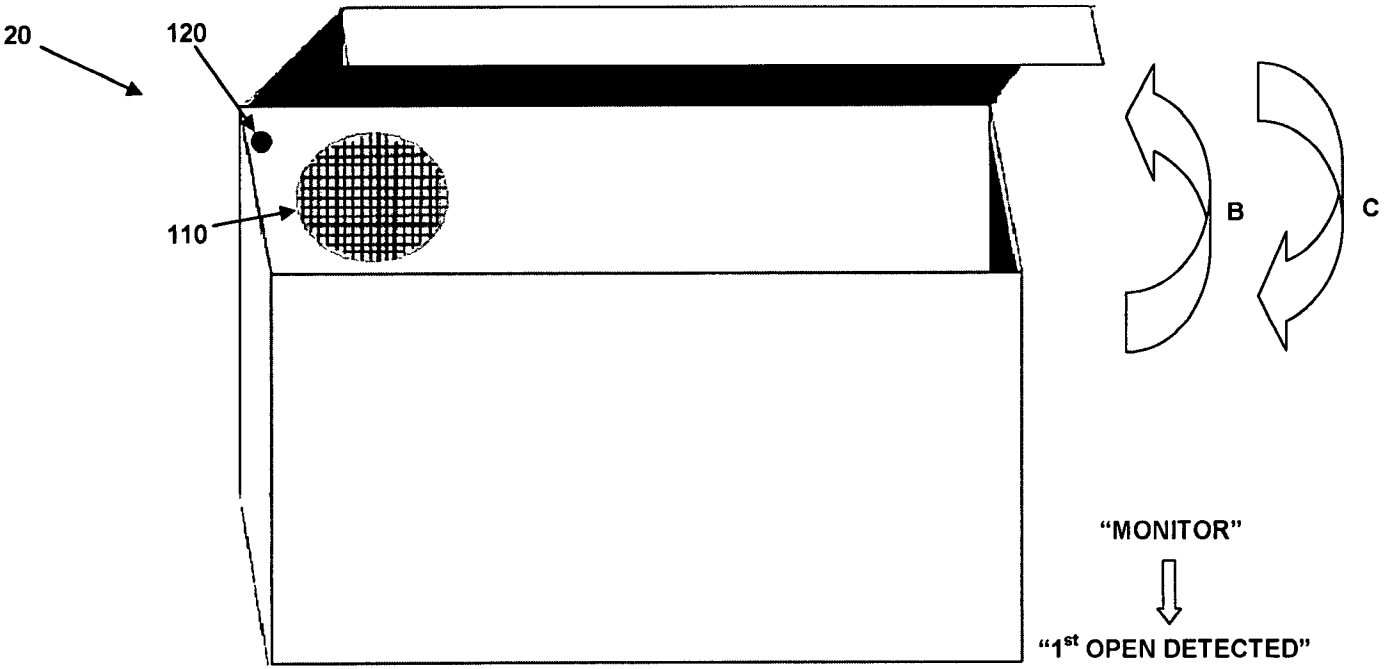

As depicted in FIG. 5, if the package 20 is subsequently opened (arrow B) (e.g., by a malicious person) before it arrives at its intended destination, the photovoltaic cell 110 is exposed to light and powers the electronic circuit 140. In response, the electronic circuit 140 updates the state of the TDMI system 10 to "1$^{st}$ open detected," and latches this state information in its permanent memory 141. It is assumed in this example that the package 20 is again closed (arrow C) and sent on its way to the intended recipient.

Figure 6:
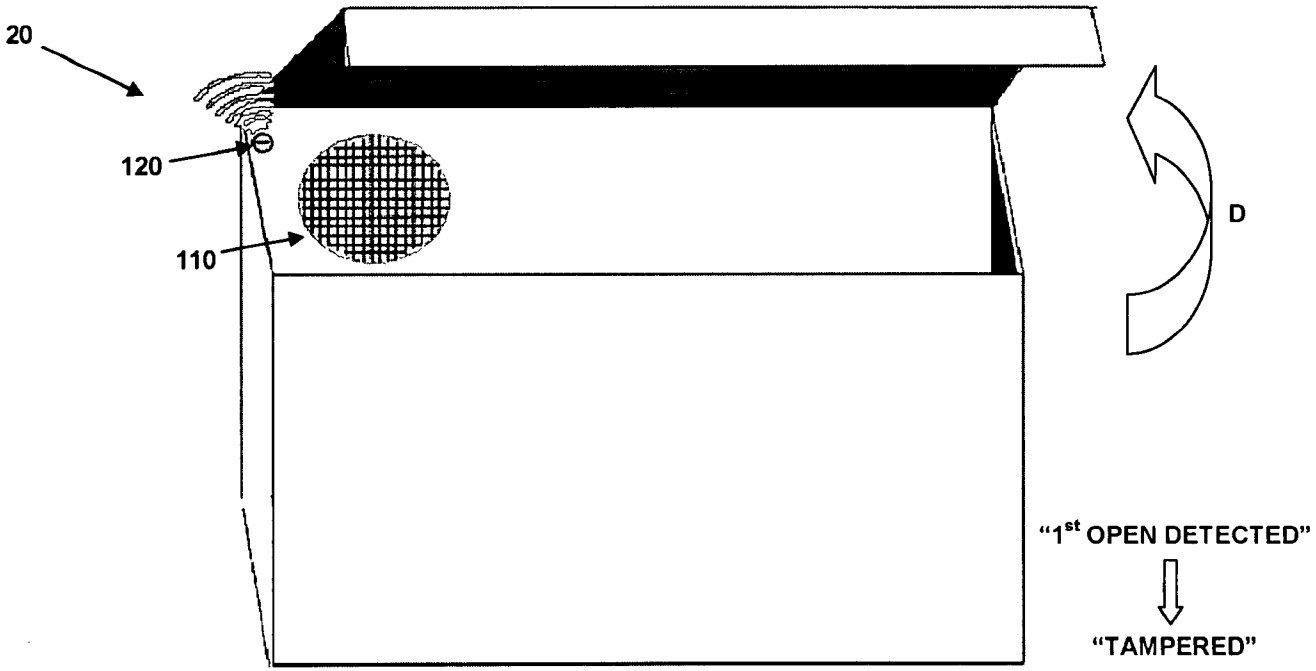

Continuing the above example, as depicted in FIG. 6, when the package 20 is subsequently opened by the intended recipient (arrow D), the photovoltaic cell 110 is again exposed to light and powers the electronic circuit 140. In response, the electronic circuit 140 updates the state of the TDMI system 10 from "1$^{st}$ open detected" to "tampered" and latches this state information in its permanent memory 141. Since the state of the TDMI system 10 is now set to "tampered," the electronic circuit 140 causes the LED 120 to be illuminated. To this extent, the illumination of the LED 120 provides an alarm that serves to notify the intended recipient of the package 20 that the package 20 has been opened between the time the package was originally closed to the time the intended recipient opened the package 20.

In the alternative case that the package 20 is not opened (e.g., by a malicious person) before it arrives at its intended destination, the photovoltaic cell 110 is not exposed to light and the status of the TDMI system 10 remains at "monitor." When the package 20 is then opened by the intended recipient, the photovoltaic cell 110 is exposed to light and powers the electronic circuit 140. In response, the electronic circuit 140 updates the state of the TDMI system 10 to "1$^{st}$ open detected," and latches this state information in its permanent memory 141. Since the state of the TDMI system 10 is set to "1$^{st}$ open detected," the electronic circuit 140 does not cause the LED 120 to be illuminated. To this extent, the lack of illumination of the LED 120 serves to notify the intended recipient of the package 20 that the package 20 has not been opened between the time the package was originally closed to the time the intended recipient opened the package 20.

In another embodiment of the present invention, the intended recipient of the package 20 can use an RFID reader (e.g., RFID reader 40, FIG. 4) to read, verify and/or reset the state of the TDMI system 10. In this embodiment, the LED 120 may or may not be provided.

Figure 7:
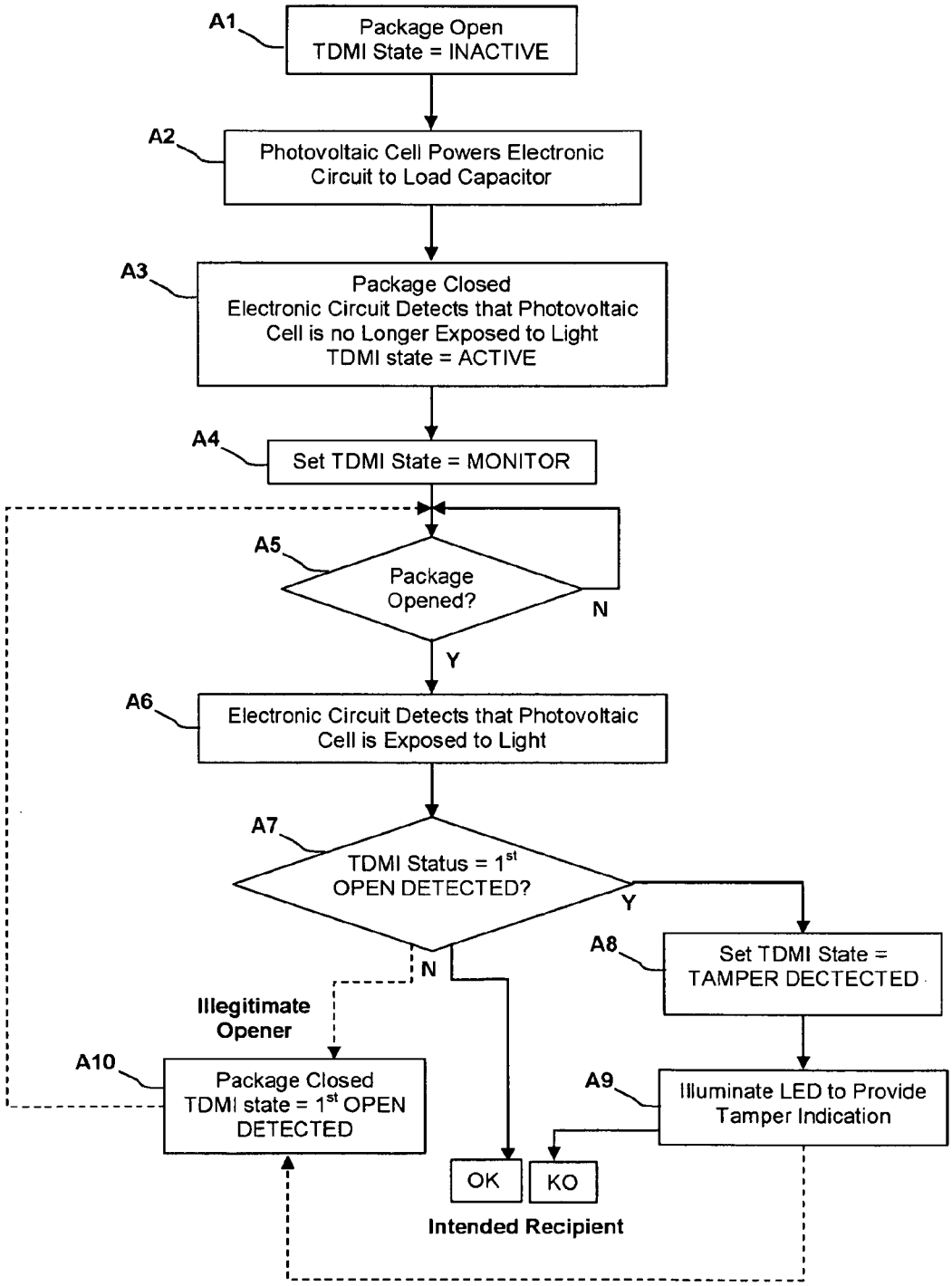
FIG. 7 depicts a flow diagram of an illustrative method in accordance with an embodiment of the present invention.

A flow diagram of an illustrative process in accordance with an embodiment of the present invention is depicted in FIG. 7 and described with regard to the components shown in FIG. 1. At A1, the package 20 is open and the state of the TDMI system is "inactive." At A2, the photovoltaic cell 110 is exposed to light and powers the electronic circuit 140, which loads the capacitor 130. At A3, the package 20 is closed. The electronic circuit 140 detects that the photovoltaic cell 110 is no longer exposed to light and sets the state of the TDMI system to "active." At A4, the state of the TDMI system 10 is set to "monitor" (e.g., using an RFID tag reader/encoder 40) and the package 20 is mailed.

When the package 20 is opened (YES, A5), flow passes to A6. In A6, the electronic circuit 140 detects that the photovoltaic cell 110 is exposed to light. If the current state of the TDMI system 10 is set to "1$^{st}$ open detected" (YES, A7), the state of the TDMI system 10 is set to "tamper detected" at A8 and the LED 120 is illuminated by the electronic circuit 140 at A9, indicating that the package 20 has been opened prior to being received by the intended recipient (KO). If the current state of the TDMI system 10 is set to "monitor" (N0, A7), the LED 120 is not illuminated by the electronic circuit 140, indicating that the package 20 has not been opened prior to being received by the intended recipient (OK). Thus, the intended recipient can receive the package in either a tampered state (KO) or an untampered state (OK). However, if the package 10 is again closed (e.g., by a malicious person), the state of the TDMI system 10 is set at A10 to "1$^{st}$ open detected" and flow passes back to A5.

It should be noted that the package 20 may be illegitimally opened several times (e.g., the process may be looped through more than once (this is indicated by the dashed lines in FIG. 7)). Note, that in this case, it may be desirable not to use the LED 120 indicator feature, in order that the illegitimate opener of the package 20 will not notice that they have been caught.

The foregoing description of the embodiments of this invention has been presented for purposes of illustration and description. It is not intended to be exhaustive or to limit the invention to the precise form disclosed, and obviously, many modifications and variations are possible.

What is claimed is:

1. A system for tamper detection of a package, comprising:

a light detecting system for detecting when the package is opened; and a system for generating an alarm if the package is opened more than once after it is initially closed to indicate that the package has been tampered with, wherein the light detecting system further comprises a photovoltaic cell, and wherein the system for generating the alarm further comprises:

an electronic circuit coupled to the photovoltaic cell;

a light emitting diode (LED) coupled to the electronic circuit for generating a visual alarm;

a capacitor coupled to the photovoltaic cell and the electronic circuit for temporarily powering the electronic circuit when the package is closed; and a radio frequency identification (RFID) tag coupled to the electronic circuit for setting a state of the electronic circuit.

2. The system of claim 1, wherein the electronic circuit further comprises:

a state machine for setting a state of the electronic circuit based on the presence or absence of light as detected by the photovoltaic cell; and a permanent memory for storing the state of the state machine.

3. The system of claim 2, wherein setting a state of an electronic circuit based on the presence or absence of light detected by the photovoltaic cell further comprises:

setting the state to active in response to an initial closing of the package;

updating the state from active to monitor via the RFID tag after the package is initially closed; and updating the state from monitor to 1$^{st}$ open detected upon a first opening of the package.

4. The system of claim 3, wherein setting a state of an electronic circuit based on the presence or absence of light detected by the photovoltaic cell further comprises:

updating the state from $1^{st}$ open detected to tamper detected upon a second opening of the package.

5. A package, comprising:

a light detecting system for detecting when the package is opened; and a system for generating an alarm if the package is opened more than once after it is initially closed to indicate that the package has been tampered with;

wherein the light detecting system and the system for generating an alarm are embedded into a material forming the package, wherein the light detecting system further comprises a photovoltaic cell, and wherein the system for generating the alarm further comprises:

an electronic circuit coupled to the photovoltaic cell;

a light emitting diode (LED) coupled to the electronic circuit for generating a visual alarm;

a capacitor coupled to the photovoltaic cell and the electronic circuit for temporarily powering the electronic circuit when the package is closed; and a radio frequency identification (RFID) tag coupled to the electronic circuit for setting a state of the electronic circuit; wherein only the photovoltaic cell and the LED are visible within the package.

* * * * *